US005377740A

United States Patent [19]

Gilley et al.

[11] Patent Number: 5,377,740

[45] Date of Patent: * Jan. 3, 1995

[54] MULTI-PURPOSE WINDOW TREATMENT SUPPORT DEVICE

[76] Inventors: Paul D. Gilley; Margaret R. Gilley, both of 120 N. First St., Eufaula, Okla. 74432

[ * ] Notice: The portion of the term of this patent subsequent to Feb. 1, 2011 has been disclaimed.

[21] Appl. No.: 67,358

[22] Filed: May 24, 1993

Related U.S. Application Data

[63] Continuation-in-part of Ser. No. 964,159, Oct. 20, 1992, Pat. No. 5,238,044.

[51] Int. Cl.[6] ..... A47H 13/14

[52] U.S. Cl. ..... 160/348; 160/38

[58] Field of Search ..... 160/348, 349.1, 19, 160/38, 39, 349.2, 330, 405; 211/87, 106, 105.1; 428/4, 5

[56] References Cited

U.S. PATENT DOCUMENTS

| | | | |
|---|---|---|---|
| D. 316,530 | 4/1991 | Clifton | D11/202 |
| 1,537,463 | 5/1925 | Holden | 211/106 |
| 1,746,577 | 2/1930 | Berglund et al. | 160/348 X |
| 2,099,507 | 11/1937 | Wright | 211/106 |
| 2,524,426 | 10/1950 | Comerford et al. | 160/348 |
| 2,534,491 | 12/1950 | Wersching | 160/348 |
| 2,557,578 | 6/1951 | Stallone | 160/348 |
| 2,598,522 | 5/1952 | Falkenberg | 160/348 |
| 2,946,378 | 7/1960 | Nordell | 211/105.1 X |
| 3,901,303 | 8/1975 | Flakenberg | 160/348 |
| 5,018,567 | 5/1991 | Hannerstig | 160/348 |
| 5,141,045 | 8/1992 | Williams | 160/348 |
| 5,217,784 | 6/1993 | Shepherd | 160/38 X |
| 5,238,044 | 8/1993 | Gilley et al. | 160/348 |
| 5,282,505 | 2/1994 | Gilley et al. | 160/348 |
| 5,307,860 | 5/1994 | Wilkinson et al. | 160/348 |

*Primary Examiner*—David M. Purol
*Attorney, Agent, or Firm*—Paul W. Hemminger

[57] ABSTRACT

An universal window treatment support device and method for supporting various lengths, sizes and types of curtain and/or drapery material in a wide variety of different decorative treatment arrangements. The holder is an elongated, relatively thin, flat rigid element containing a number of openings of different sizes and shapes along its length and having an elongated rod of small cross-section extending across the lower portion thereof. The device is vertically mounted in front of an area to be decorated and looped sections of material is passed from the back of the holder to its front through one or more of the openings or looped over the elongated rod after which the looped sections are fluffed out or draped in front of the holder to provide individualized decorative treatments. The elongated rod is adaptable for passing through hemmed openings of flat panels of sheer material to provide a light filtering function.

11 Claims, 4 Drawing Sheets

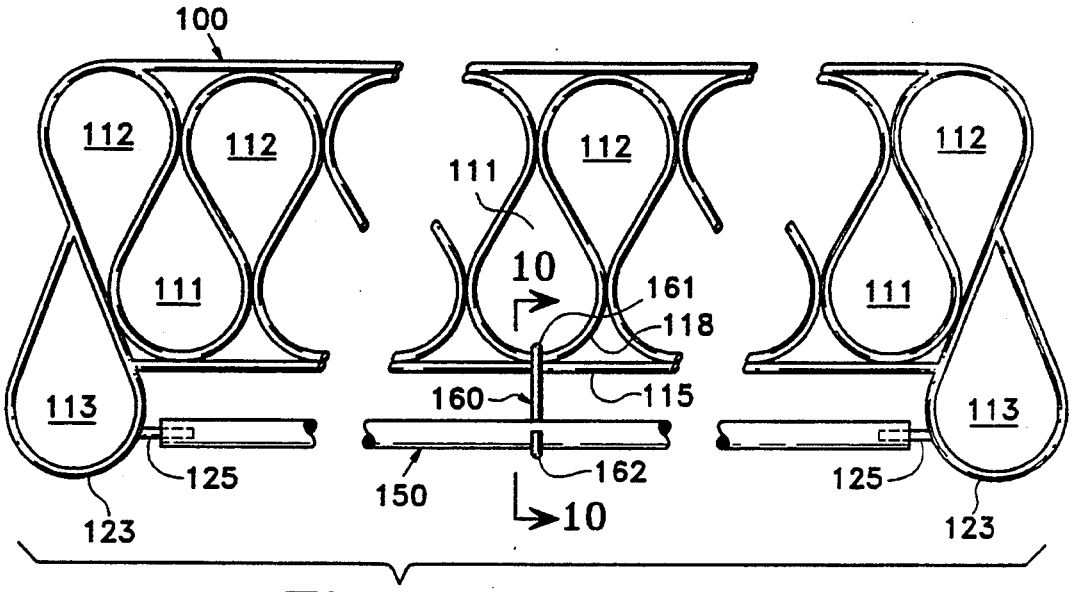
Fig. 9
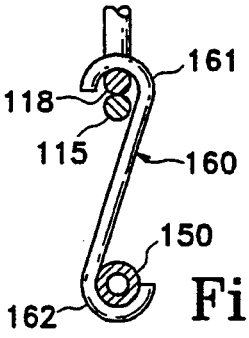
Fig. 10
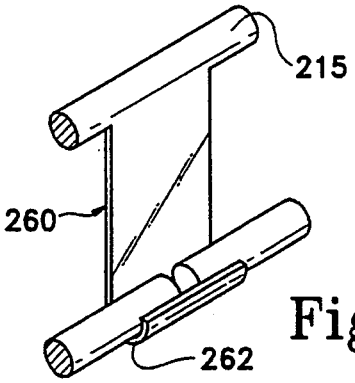
Fig. 12
Fig. 11
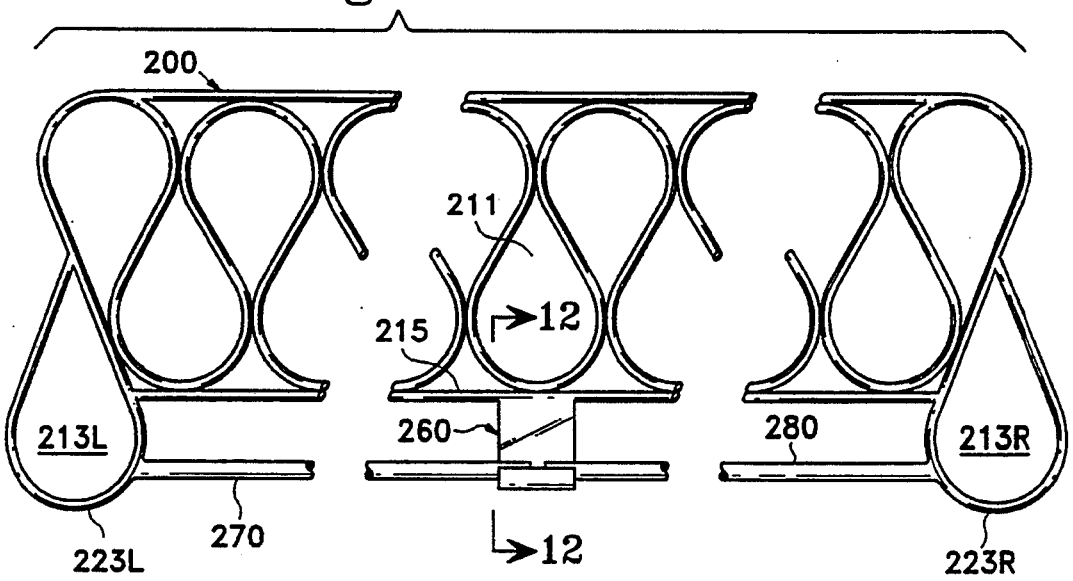

MULTI-PURPOSE WINDOW TREATMENT SUPPORT DEVICE

This is a continuation-in-part of application Ser. No. 07/964,159 filed Oct. 20, 1992, now U.S. Pat. No. 5,238,044 and entitled Window Treatment Support Device.

BACKGROUND

1. Field of the Invention

The present invention relates in general to fixtures and devices for supporting and positioning window curtains and draperies and in particular to a universal support device for supporting various lengths of curtain and/or drapery material or fabric in an unlimited number of different decorative treatment arrangements.

2. The Prior Art

Curtain and drapery fixtures, traverse rods, supports, ring bars and the like are known which are designed to support, shape, arrange and position curtains or drapes in an orderly and specific manner. With these prior-art devices, little or no variation in window treatment appearance is possible except by (i) substitution of different-colored or different-lengthed curtains or drapes which would still be supported in the specific manner dictated by the design of the support elements, or by (ii) replacing the support elements with ones designed to create a specific but different window treatment appearance.

Other support devices are known which will cause unpleated curtains or drapes to assume a pleated or folded position when affixed to such supports, but again there is little variation possible in the overall appearance of the window treatment as substitute drapes will still appear pleated and folded drapes will still appear folded, even though their length or color may be changed.

In these prior-art devices, it is customary to mount a separate support element for draperies, for valances, fox sheers and the like, resulting in a plurality of mounting devices of different types and lengths all being mounted at the top of the area being decorated. Utilization of a number of mounting elements at a single area or location is expensive, the mounting elements are crowded closely together, usually one in front of the other, and difficulty is encountered in installing and removing the various materials for cleaning.

SUMMARY OF THE INVENTION

The present invention resides in an elongated relatively-flat, multi-purpose window treatment support device and mounting means for securing the support device in a vertical position above and a spaced distance in front of a window or area to be decorated.

The window treatment support device has a plurality of material-receiving apertures therein whereby a single length, or a number of lengths, of unhemmed or finished curtain or drapery material or fabric may be simply and easily hung, arranged and displayed in a wide variety of decorative arrangements without the need for clips, pins, hooks or catches, yet such material or fabric is easily removable for washing or cleaning. This is accomplished by passing the ends or an intermediate part of the fabric lengths through one or more material-receiving apertures in the support device and then loosely draping or fluffing out the material to conceal the support device and to create any of a number of decorative treatment arrangements.

By providing material-receiving apertures of different sizes and shapes, the multi-purpose window treatment support device will simultaneously support and display fabrics and material of different thicknesses and bulkiness.

By providing material-receiving apertures with V-shaped notches, the present invention will simultaneously support and display heavy fabrics as the V-shaped notches automatically grip and hold the fabric against slippage which could occur with heavy fabrics that are not secured by clips or other retaining means.

The multi-purpose window treatment support device includes a transverse element or straight rod which is positioned below the material-receiving apertures and which may be utilized to support portions of the draped material that has already been passed through the material-receiving apertures from either the front or back of the support device to provide additional artistic window treatment arrangements. These transverse elements may also be utilized to support flat panels of light-filtering materials such as sheers, which heretofore were mounted on separate rods, usually behind the well-known traverse rods and valance supports.

BRIEF DESCRIPTION OF THE DRAWINGS

The present invention will be better understood from the following detailed description of several embodiments of the invention when considered in connection with the accompanying drawings in which:

FIG. 9 is a front elevational view of the support device shown in FIG. 1 with a removable transverse element or fabric support rod;

FIG. 10, taken along lines 10—10 of FIG. 9, is a side elevational view of the central support element for the removable fabric support rod;

FIG. 11 is a front elevational view of the support device shown in FIG. 1 with a multi-element fabric support rod which is separable at its center;

FIG. 12, taken along lines 12—12 of FIG. 11, is a perspective view of the central support element for the multi-element fabric support rod;

DESCRIPTION OF THE SEVERAL EMBODIMENTS OF THE INVENTION

Figure 1:
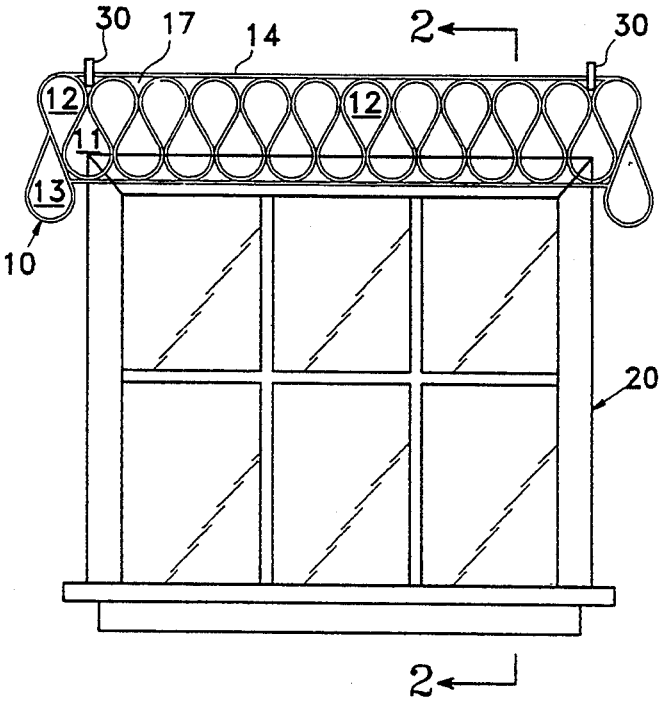
FIG. 1 is a front elevational view of one embodiment of the invention shown positioned with respect to a window which will receive decorative treatment.

Referring to the drawings, the embodiment of this invention shown in FIGS. 1 through 5 will now be described. In these drawings, like reference numerals will represent corresponding elements.

It is to be noted that while the various embodiments are described in connection with window treatments, the inventive support device is equally useful in providing decorative treatments for walls, alcoves, doorways and the like.

Figure 2:
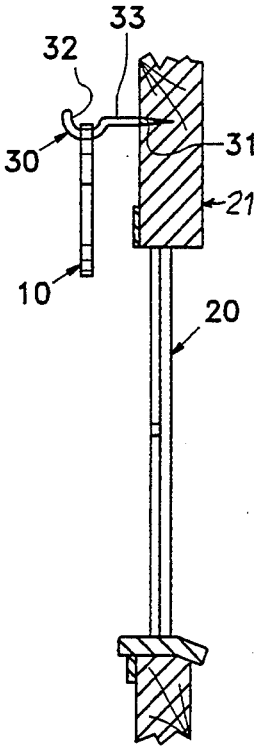
FIG. 2, taken along lines 2—2 of FIG. 1, is a side elevational view of the embodiment of the invention disclosed in FIG. 1.

As best seen in FIGS. 1 and 2, the window treatment support device 10 is an elongated, relatively narrow flat structure and is shown mounted above and in front of window 20 by laterally extending mounting elements 30 having one end secured to a supporting structure such as wall 21 and the other end engaging upper rail 14 to support and maintain support device 10 in a vertical position.

While mounting element 30 is shown as a cup hook width the threaded end 31 screwed into wall 21, it could be attached to the wall by a butt plate or other securing means. Also, the semicircular hook end 32 could be V-shaped or rigidly attached to the upper rail 14 as long as support device 10 was mounted vertically. Still further, the length of shank 33 of mounting element 30 is not critical as long as it is of sufficient length to permit space for the drapery material or fabric to pass between support device 10 and wall 21. Alternatively, device 10 could be suspended from the ceiling or attached to movable floor uprights.

Figure 3:
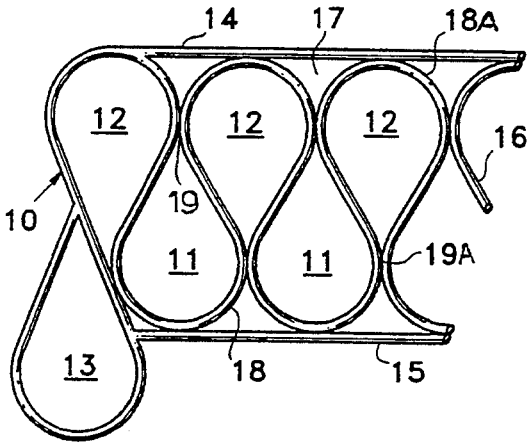
FIG. 3 is an enlarged front view of a portion of the embodiment shown in FIG. 1.

As best seen in FIGS. 1 and 3, support device 10 comprises a first series of tear-shaped material-receiving apertures 11 arranged in side-by-side relationship with each material-receiving aperture 11 having a semicircular base 18 and an opposing V-shaped notched section 19 upwardly directed, and comprises a second series of similarly shaped material-receiving apertures 12 arranged in side-by-side relationship with each material-receiving aperture 12 having a semicircular base 18A and opposing V-shaped notched section 19A downwardly directed. A similarly shaped corner material-receiving aperture 13 with its V-shaped notched section directed upwardly is located at each end of the series of material-receiving apertures 11. The upper and lower peripheries of the flat support device 10 are bounded by respective upper and lower rails or strengthening structures 14 and 15.

Figure 6:
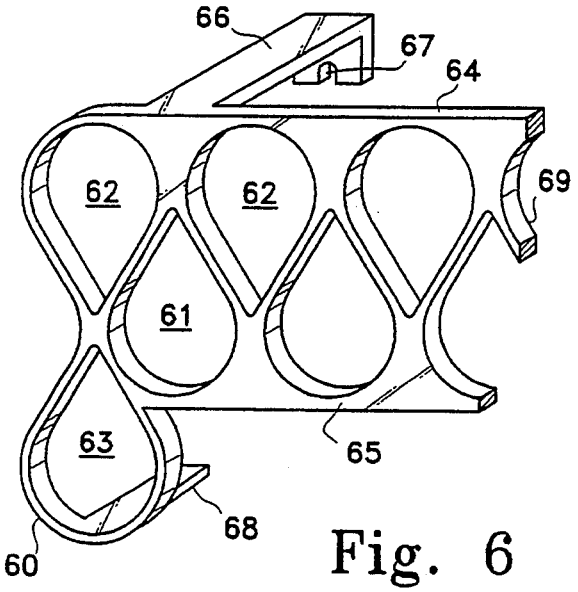
FIG. 6 is a front view of a portion of another embodiment of the invention with integrally formed support arms.
Figure 7:
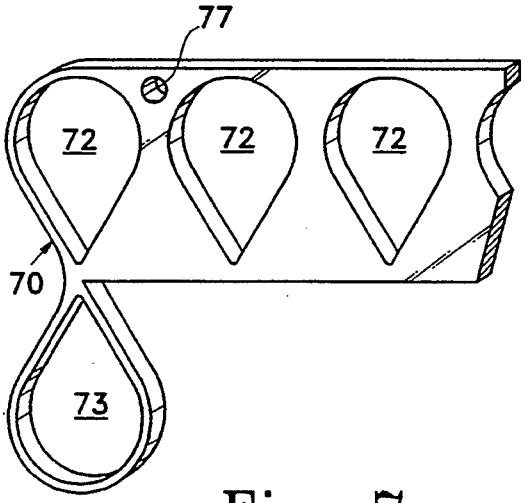
FIG. 7 is a front view of a portion of still another embodiment of the invention showing a single row of material-receiving apertures.
Figure 8:
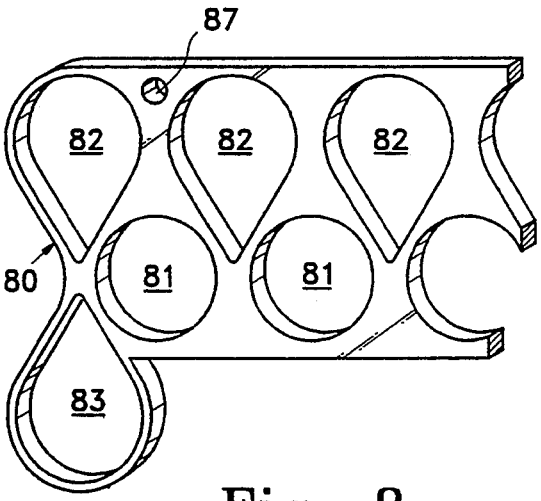
FIG. 8 is an enlarged front view of a further embodiment of the invention showing two rows of differently sized and differently shaped material-receiving apertures.

It is to be noted that the rails 14 and 15 and the walls defining material-receiving apertures 11, 12 and 13 are rigidly constructed and secured together to prevent any movement therebetween. Also, while these rails and walls are shown in FIG. 3 with a circular cross-section, the entire device 10 when viewed from either end has a rectangular cross section. However, it is to be noted that the rails and walls in FIG. 3 could have square or rectangular cross-sectional shapes as shown in FIGS. 6 through 8 without departing from the spirit and scope of the invention. Also, while support device 10 is illustrated as having twenty five material-receiving apertures, the number and sizes of material-receiving apertures could be increased or decreased to fit various sized areas which might be selected to receive decorative treatment.

The openings 17 formed from the abutment of the walls of material-receiving apertures 12 with the upper rail 14 provide a suitable space for the semicircular hook end 32 of mounting element 30 to engage and mount support device 10 in a vertical position. When heavy drapery fabric or material is used, additional mounting elements 30 may be used to engage upper rail 14 intermediate its ends to prevent any possible distortion of support element 10 from the weight of the fabric.

Figure 4:
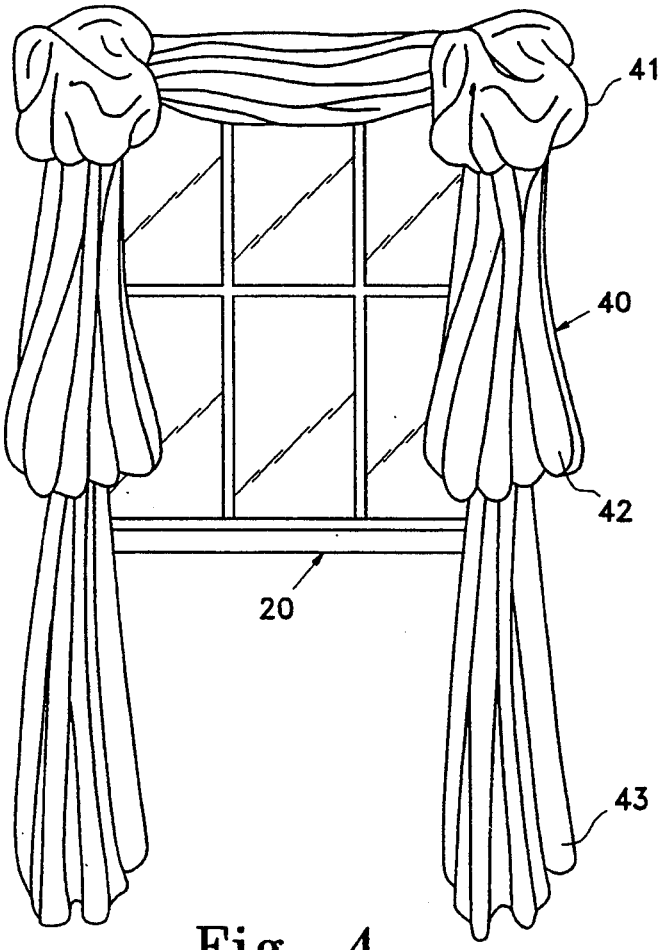
FIG. 4 is a front view of a pictorial representation of the window area in FIG. 1 decorated with fabric or drapery supported on the inventive support device.
Figure 5:
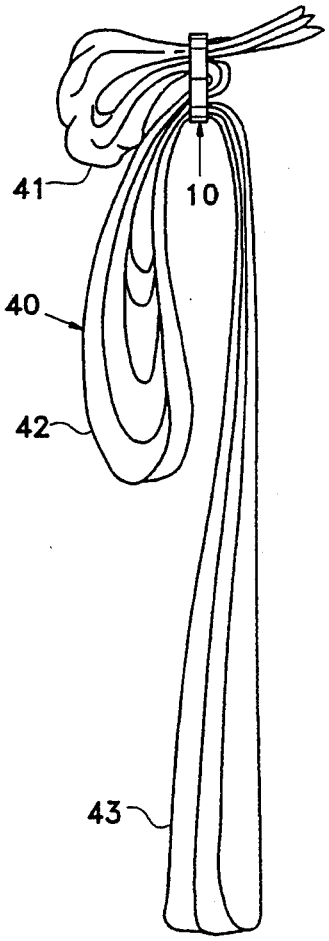
FIG. 5 is a side view of a pictorial representation of the window treatment shown in FIG. 4.

Referring now to FIGS. 4 and 5, a brief description will be given of one example of the use of the inventive device for decorative treatment of the window shown in FIG. 1.

In the particular treatment being described, the length of the fabric 40 to be used is generally determined by adding the lengths of the two sides and top of the treatment being planned, plus approximately one foot for each material-receiving aperture 11 or 12 that will be used, plus approximately one yard for each corner of the window treatment. The decorator will maintain the middle of the selected length of material in the center of support device 10 and will pass one foot of looped material from the back of device 10 to the front thereof through an end material-receiving aperture 12 and then pass one yard of looped material through the adjacent corner material-receiving aperture 13. The remaining material on the half-length that is being arranged will hang or drape in folds 43 or puddle on the floor. The other half-length of the material 40 is similarly looped through the other end material-receiving aperture 12 and corner material-receiving aperture 13. The material looped through material-receiving apertures 12 is billowed out to form ruffle 41 and the material looped through material-receiving apertures 13 is arranged in the form of draped sleeves 42. Finally, slight adjustments are made to provide symmetry between both sides of the decorative treatment.

Decorative material may be passed through the material-receiving apertures while the support device 10 is vertically mounted but many users prefer to do most of the decorative arrangements while the support device is flat on a work table, for example.

Figure 13:
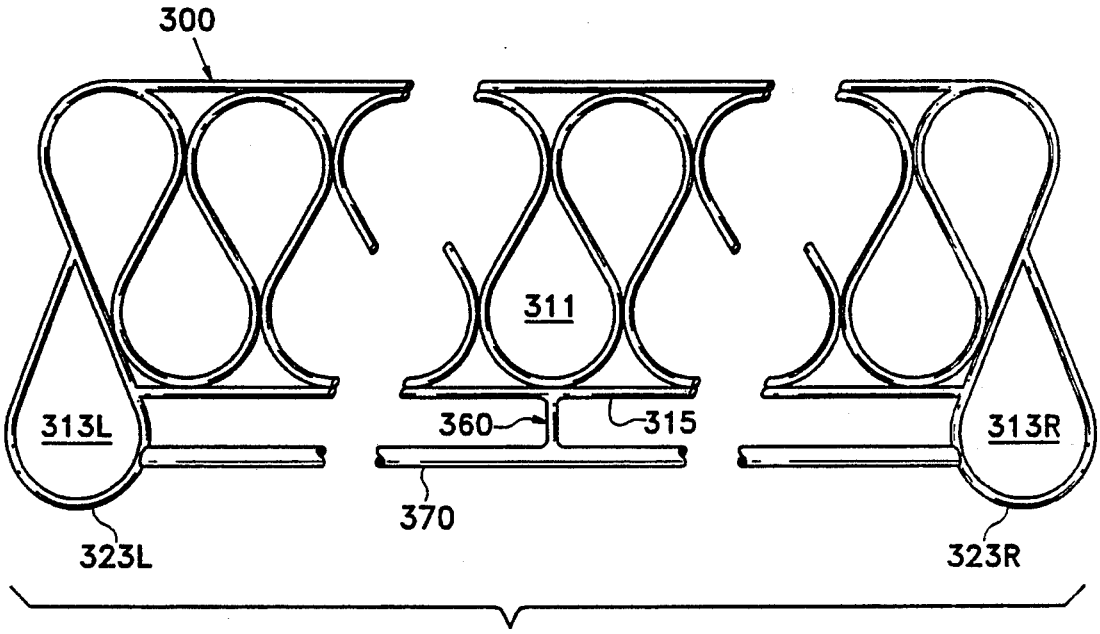
FIG. 13 is a front elevational view of the support device shown in FIG. 1 with a fabric support rod which is integral with the window treatment support device.

It is to be noted that the material looped through any of the material-receiving apertures may be again looped and passed between rail 115 and the fabric support rod 150 shown in FIG. 9, or passed between rail 215 and the fabric support rod 270 shown in FIG. 11, or passed between rail 315 and the fabric support rod 370 shown in FIG. 13. This material looping over the fabric support rods in addition to being passed through the material-receiving apertures permits numerous unique decorative treatments by creating double draped sleeves, for example.

While two or more contrasting types of fabric can be used, only one type of fabric is illustrated and while numerous of the other material-receiving apertures 11 and 12 can be used to support the fabric, only the corner material-receiving apertures 13 and immediately adjacent material-receiving apertures 12 are used in the FIG. 4 and FIG. 5 pictorial representation. However, it can be seen that an unlimited number of decorative treatments can be created by using different ones of the material-receiving apertures, with or without utilizing the fabric support rods, and by arranging the looped material in different lengths and forms.

Referring now to FIG. 6 of the drawings, the embodiment there disclosed will be described.

The window treatment support device 60 differs from support device 10 of FIG. 1 in that the walls between adjacent material-receiving apertures of support device 60 are of a rectangularly-shaped cross-sectional configuration and in that the mounting bracket 66 and stablizing bracket 68 are an integral part of the upper and lower rail sections 64 and 65.

The window treatment support device 60 is mounted on the wall or window area by hooking notch 67 over a nail or screw which is appropriately secured to the wall. The stablizing bracket 68 aids in maintaining the support device in a vertical position, and if desired, the free end thereof may be rigidly secured to the wall. The material-receiving apertures 61, 62 and 63 of FIG. 6 are tear-shaped with a semicircular base and opposing V-shaped notch and are arranged in side-by-side relationship, all as described in connection with respective material-receiving apertures 11, 12 and 13 of FIG. 3.

A support device 70, shown in FIG. 7, is specifically designed for window treatments using heavy or bulky material in that only one series of side-by-side material-receiving apertures 72 are provided and such apertures have their V-shaped notches downwardly extending. As previously pointed out, the weight of the free ends of heavy or bulky fabric will tend to pull the short looped portions out of the material-receiving apertures. This problem has been overcome by providing the material-receiving apertures with the noted V-shaped notches which wedge portions of the fabric together and thus prevent easy retraction of the looped material unless it is deliberately moved out of the gripping notch. The longer looped length of fabric used to form sleeves has relatively equal weight on both sides of material-receiving aperture 73 so that the looped fabric has little tendency to pull out of its captivating aperture. While window treatment support device 70 shows an opening 77 for receiving, for example, a hook end such as shown on mounting bracket 30 of FIG. 3, it is to be understood that device 70 could have a mounting bracket similar to bracket 66 of FIG. 6.

Some window treatments may use two or more fabrics with different prints, colors or weaves, or such window treatments may use heavy fabrics together with sheer fabrics. The window treatment support device 80 shown in FIG. 8 is specifically designed for supporting both heavy-weight and light-weight material. As pointed out in connection with the description of support device 70, the loop-receiving apertures 72 with downwardly extending V-shaped notches securely hold heavy fabrics in position. Thus, window treatment support device 80 contains a series of side-by-side loop-receiving apertures 82 for receiving heavy or bulky fabrics. Support device 80 also includes a series of side-by-side loop-receiving apertures 81 of generally circular configuration through which light-weight or sheer material may be looped without the tendency of the loops to be pulled out of their apertures as the free ends of such material does not exert much downward force. The circular apertures 81 encompass less area that the tear-shaped apertures 82 and thus less opening is visible when a small volume of sheer fabric is passed therethrough.

As pointed out hereinbefore, it is customary to, provide separate support rods or devices for sheer fabrics since the support rods for sheer materials are preferably straight as sheer or light filtering fabrics are usually hung as flat panels without clusters of folds or thick gatherings of material. Drapery support devices or valance support devices are usually designed to arrange materials in decorative arrangements and it is common for such devices to have non-linear configurations which are unsuitable for the flat panels of sheer materials.

Referring to FIGS. 9 through 15, a number of further variations of the support device of FIG. 1 to support both flat panels of sheer material and decorative arrangements of drapery materials will now be described. While not shown in FIGS. 9, 11 and 13, it is to be understood that the support devices 100, 200 and 300 may be mounted in a vertical plane by the mounting means such as those described in connection with FIGS. 1 through 8.

Support device 100 comprises a first and second series of material-receiving apertures 111 and 112 arranged in side-by-side relationship with a pair of end apertures 113, all as generally disclosed and described in connection with FIGS. 1 and 3. In FIG. 9 however, the semicircular base 123 of each of the end apertures 113 has a short stub or pin 125 extending horizontally therefrom in opposing relationship to each other and parallel to lower rail 115. A hollow fabric support rod 150 of a length slightly shorter than the distance between the opposing sidewalls 123, is supported at its ends by studs 125 being manually positioned into the hollow portion of the rod. Rod 150 is slightly flexible along is axis and after the hollow end is slipped over one stud 125, the rod is flexed or bowed intermediate its ends sufficient for the free end of the rod to be guided to encircle the other stud 125. While rod 150 is shown as a hollow tube, it could have a solid cross-section with openings at its ends. Conversely, the ends of the fabric support rods 150 could contain projections adaptable to pass through corresponding openings in the sidewalls 123 of device 100.

As best seen in FIG. 10, rod support element 160 has an S-shaped configuration with the curved upper portion 161 partially encircling the sidewall 118 of centrally located aperture 111 and the curved lower portion 162 partially encircling rod 150. The rod support element 160 is easily positioned over rod 150 and the sidewall 118 of aperture 111 by hooking the curved upper portion 161 over the sidewall 118, slightly flexing rod 150 in a direction toward bottom rail 115 and then hooking the curved lower portion 162 over rod 150.

In order to install sheers or light-filtering fabric on support device 100, the rod 150 is flexed in the direction of bottom rail 115, the rod support element 160 is removed from encircling relationship with rod 150, rod 150 is then flexed intermediate its length to disengage one of its ends from stud 125, and the other end is then removed from the other stud. Once removed from support device 100, rod 150 is then fed through the hemmed opening of one or more panels of fabric to be hung. Thereafter rod 150, with the sheer panels supported thereon, is flexed sufficiently to engage the studs 125 after which it is again flexed to permit rod support element 160 to be positioned to support rod 150 at its midpoint.

If an odd number of panels of sheer material is placed on rod 150, it may be necessary to pass the lower curved section 162 of support element 160 through the hemmed material of the center panel in order for element 160 to properly engage rod 150. In order to remove the panels, the support element 160 is unhooked and the rod is flexed and removed from the studs 125.

Referring now to FIGS. 11 and 12 of the drawings, another embodiment of the invention will be described.

In this embodiment, the semicircular base 223L of the end aperture 213L has a flexible rod 270 extending laterally therefrom toward the center of support device 200 and similarly the semicircular base 223R of end aperture 213R has a flexible rod 280 extending laterally therefrom toward the center of support device 200, with the free ends of rods 270 and 280 being supported by the curved portion 262 of rod supporting device 260 which is integrally formed with lower rail 215.

In order to install sheer fabrics on support device 200, the free end of support rods 270 and 280 are each flexed upwardly and outwardly to disengage them from the curved portion 262 of rod supporting element 260. Thereafter, the hemmed openings of one or more panels of sheer material are passed over rod 270 and similarly the hemmed openings of one or more other panels of sheer material are passed over rod 280. Both rods 270 and 280 are then flexed to again seat the end portions of such rods within the curved portion 262 of rod support element 260. The reverse procedure is followed to remove the sheer panels when desired.

In FIG. 13, a support fabric rod 370 is provided which is parallel to lower rail 315 of support device 300 and which extends between the semicircular base 323L of end aperture 313L and the semicircular base 323R of end aperture 313R. The ends of rod 370 are rigidly and non-removably secured to respective ones of such end apertures and the middle of rod 370 is rigidly and non-removably secured to lower rail 315 by link 360.

In order to support panels of sheer material, the rod 370 is severed at each end near the point where it is connected to the end apertures and the free ends thereof are flexed to permit the passage thereover of the hemmed opening of panels of sheer material. After the sheer material is supported on rod 370, a sleeve element 390, having an inside diameter slightly larger than the outside diameter of rod 370, is each passed over the respective free ends of the rod. The severed ends of the rods are then re-aligned and the sleeves 390 are positioned as shown in FIG. 12 to prevent the sheer panels from sliding off the severed ends of support rod 370. To remove the panels, the sleeve is moved away from the point of rod severance, the rod is flexed and the sleeve and sheer panels are removed.

Figure 15:
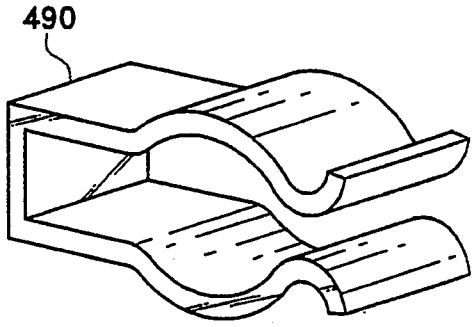
FIG. 15 is a perspective view of a yieldable clamp suitable for attachment to various sections of the support device of FIG. 1 to receive and hold removable fabric support rods.
Figure 14:
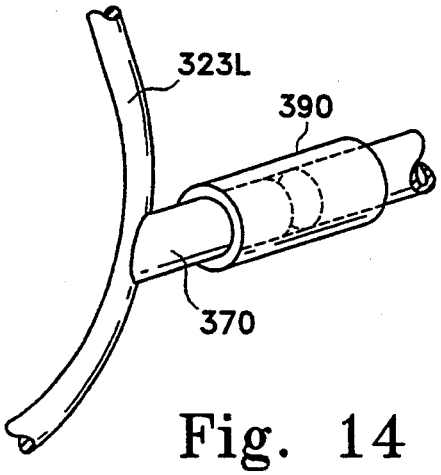
FIG. 14 is a perspective view of a splicing sleeve which has been placed on and moved into splicing position on one section of the fabric support rod of FIG. 13 which has been severed.

A yieldable clamp 490, such as shown in FIG. 15, could be attached by suitable means to the front of the support devices 100, 200 or 300 at the various points where the support rods of FIGS. 9 through 13 are attached to the respective end apertures. Under such arrangements, the ends of support bars having sheer materials supported thereon could be readily snapped into and securely engaged by the clamps 490.

It is to be noted that the presence of sheer or other material on the fabric support rod will not preclude material already passed through the material receiving apertures from being further looped over the fabric support rod as hereinbefore described.

While several embodiments of the invention have been disclosed and described, it is to be understood that numerous changes may be made to the inventive device without departing from the scope and spirit of the invention as set out in the appended claims.

What is claimed is:

1. A method for creating decorative treatment arrangements utilizing a relatively flat elongated support device having a row of spaced-apart material receiving apertures extending along the length thereof and having an elongated fabric rod positioned a spaced distance from and parallel to said row of apertures, the method comprising the steps of;

folding a plurality of sections of a first length of decorative material;

passing the folded sections through respective apertures in the support device with the folded portion of each section projecting forward of its respective aperture;

artistically arranging the material in selected ones of the projecting folded portions to form decorative shapes;

folding and passing other selected ones of the projecting folded portions through the opening between the said row of apertures and the support rod to form a valance forward of the support rod; and mounting the support device and fabric thereon in a vertical plane in front of the area to be decorated with the said decorative shapes facing forwardly therefrom.

2. The method as set forth in claim 1 wherein a second fabric is passed over and supported by the elongated fabric rod.

3. A method for creating decorative treatment arrangements utilizing a relatively flat elongated support device having a row of spaced apart material receiving apertures extending along the length thereof and having an elongated detachable fabric rod positioned a spaced distance from and parallel to said row of apertures, the method comprising the steps of;

folding a plurality of sections of a first length of decorative material;

passing the folded sections through respective apertures in the support device with the folded portion of each section projecting forward of its respective aperture;

artistically arranging the material in selected ones of the projecting folded portions to form decorative shapes; and detaching the elongated fabric rod from the support device, passing the fabric rod through hemmed openings of a second length of material and reattaching the fabric rod to the support device with the second material downwardly extending therefrom.

4. The method set forth in claim 3 wherein certain of the projecting folded portions are disposed downwardly and forward of the fabric support rod to form a valance therealong.

5. A method for creating an area treatment comprising the steps of:

a. determining the length of fabric needed to create the desired area treatment, b. obtaining the desired length of fabric, c. selecting an area treatment support device having a row of material-receiving apertures extending the entire length of the support device with the material-receiving aperture at each end of the support device having an auxiliary aperture adjacent thereto and laterally disposed from said row of material-receiving apertures, d. passing a portion of the fabric through one of the material-receiving apertures to form a gathering of material, e. passing additional portions of the fabric through additional material-receiving apertures until the desired number of gatherings of material has been formed along the length of the support device, f. passing another portion of the fabric through at least one of the auxiliary apertures to form an auxiliary gathering of material at one end of the support device, g. fluffing out the gatherings of material extending along the length of the support device and arranging the auxiliary gatherings to obtain the desired decorative area treatment, and h. positioning the support device with the formed desired decorative treatment above the area to be decorated.

6. The method of claim 5 wherein mounting elements are installed above the area to be decorated and wherein the support device with the desired decorative treatment is positioned on said mounting elements.

7. The method of claim 5 wherein the length of the fabric in each auxiliary gathering of material is greater than the length of fabric in any of the fluffed out gatherings of material extending along the length of the support device.

8. The method of claim 7 wherein the auxiliary gatherings of material at each end of the support device are disposed below the fluffed out gatherings of material extending along the length of the support device.

9. A method for creating an area treatment comprising the steps of:

a. determining the length of fabric needed to create the desired area treatment, b. obtaining the desired length of fabric having an intermediate section and a first and second end section, c. selecting an area treatment support device having a row of material-receiving apertures extending the entire length of the support device with the material-receiving aperture at each end of the support device having an auxiliary aperture adjacent thereto and laterally disposed from said row of material-receiving apertures, d. passing a first portion of material in each end section of the length of fabric through respective ones of said end material-receiving apertures to form end gatherings of material, e. passing a second portion of material in each end section of the length of fabric through respective ones of said adjacent auxiliary material-receiving apertures to form auxiliary gatherings of material, f. arranging the end gatherings and the auxiliary gatherings of material to obtain the desired decorative area treatment, and g. positioning the support device with the formed desired decorative treatment above the area to be decorated.

10. The method of claim 9 wherein said intermediate section of the length of fabric is draped along the length of the support device intermediate said end gatherings to conceal the area treatment support device.

11. The method of claim 9 including the further steps of passing portions of said intermediate section through respective material-receiving apertures intermediate said end material-receiving apertures to form intermediate gatherings of material, and fluffing out the intermediate gatherings of material to conceal the area treatment support device.

* * * * *